United States Patent [19]

Bisson

[11] Patent Number: 4,608,938

[45] Date of Patent: Sep. 2, 1986

[54] FABRIC PIECE STACKER APPLIED TO A SEWING MACHINE

[75] Inventor: Flavio Bisson, Cava Manara, Italy

[73] Assignee: Necchi Societa per Azioni, Pavia, Italy

[21] Appl. No.: 792,594

[22] Filed: Oct. 29, 1985

[30] Foreign Application Priority Data

Feb. 8, 1985 [IT] Italy ..... 42903 A/85

[51] Int. Cl.[4] ..... D05B 33/00

[52] U.S. Cl. ..... 112/121.29; 271/175

[58] Field of Search ..... 112/121.29; 271/194, 271/195, 66, 175, 267

[56] References Cited

U.S. PATENT DOCUMENTS

| | | | |
|---|---|---|---|
| 3,712,609 | 1/1973 | Robert | 271/175 |
| 3,741,052 | 6/1973 | Frost et al. | 112/121.26 |
| 3,749,397 | 7/1973 | Timm | 112/121.26 |
| 3,788,248 | 1/1974 | Marforio | 112/121.29 |
| 4,067,272 | 1/1978 | Marforio | 271/175 |
| 4,102,284 | 7/1978 | Rohr | 112/121.29 |
| 4,239,205 | 12/1980 | Bourque | 271/175 |
| 4,399,991 | 8/1983 | Everall et al. | 271/175 |

FOREIGN PATENT DOCUMENTS

| | | | |
|---|---|---|---|
| 826920 | 1/1952 | Fed. Rep. of Germany | 271/175 |
| 1345141 | 1/1974 | United Kingdom | 271/175 |

*Primary Examiner*—Ronald Feldbaum

*Attorney, Agent, or Firm*—Stevens, Davis, Miller & Mosher

[57] ABSTRACT

Fabric piece stacker applied to a sewing machine which permits loading and sewing a piece while the stacker is in its operative phase, comprising a vertical element at an end of which a first rod is pivoted, connected in turn, through a pin, to a second rod; two parallel bars are fixed at the free ends of the rods and pneumatic cylinders are provided for enabling the vertical element and the two rods to oscillate in sequence in order to stack the sewn piece.

4 Claims, 5 Drawing Figures

FABRIC PIECE STACKER APPLIED TO A SEWING MACHINE

BACKGROUND OF THE INVENTION

The present invention relates to a fabric piece stacker applied to a sewing machine.

In automatic units composed, for example, of a loading station and of a sewing station, the fabric piece is automatically transferred from the loading station to the sewing station. After the fabric piece has been sewn, it is automatically unloaded from the fore part of the unit by a stacking device. When the stacking device returns to its inoperative position, a new piece is transferred to the sewing station. During the operation of the stacking device it is not possible to transfer a new fabric piece from the loading station to the sewing station because, in returning to its inoperative position, the stacking device interferes with the new fabric piece to be sewn. An automatic unit of this type, in order for it to be competitive with already existing units employed for similar works, it is necessary to obtain a high productivity. To reach the high productivity, the inoperative time of the sewing station must be reduced.

The stacking devices, known in the art, prevent a fabric piece to be sewn from being transferred from the loading station to the sewing station during the time the stacking device is returning to its inoperative position. The inoperative time of the machine is therefore high and, as a consequence, there is a reduction in the productivity of the automatic unit.

It is an object of the present invention to provide a stacker which permits loading and sewing of a piece while the stacker is in its operative phase.

The technical problem to be solved was to develop a stacker which permits loading and sewing a fabric piece while the stacker is in its operative phase.

SUMMARY OF THE INVENTION

The solution of that technical problem is a stacker comprising a vertical element, a first rod axially rotatable at an end of the element, a second rod connected to the first rod by a pin, two parallel bars fixed at the free ends of the rods, adapted to engage a sewn fabric piece and to stack it on a support, and means in the form of pneumatic cylinders provided to enable the vertical element and rods to oscillate.

BRIEF DESCRIPTION OF THE DRAWINGS

Further characteristics and advantages will become apparent from the following description and from the enclosed drawings, in which.

DETAILED DESCRIPTION OF THE INVENTION

Figure 1:
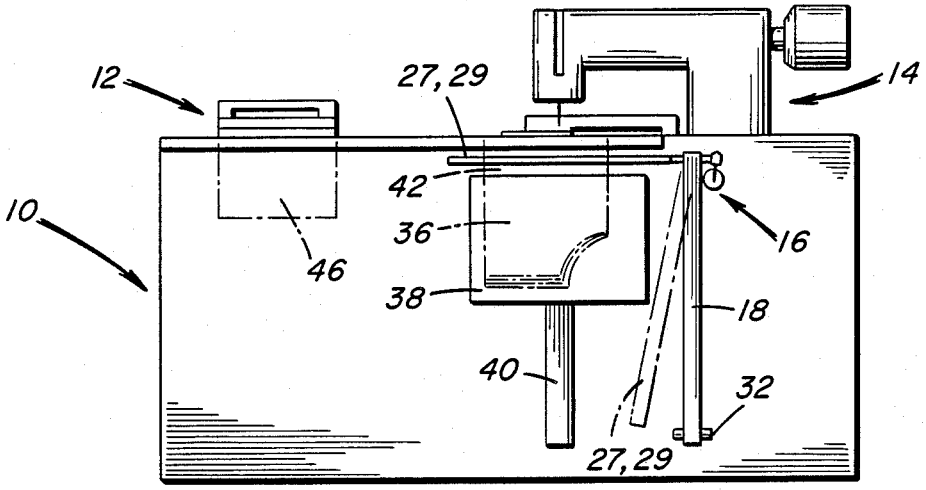
FIG. 1 is a frontal view of the automatic stacking unit of the present invention.

With reference to FIG. 1, an automatic sewing unit is generally indicated with 10 which is composed of a loading station 12 and of a sewing station 14. In the fore part of unit 10, near the sewing station 14, a stacker 16 is provided, adapted to unload and to stack fabric pieces on which automatic sewing has taken place.

Figure 2:
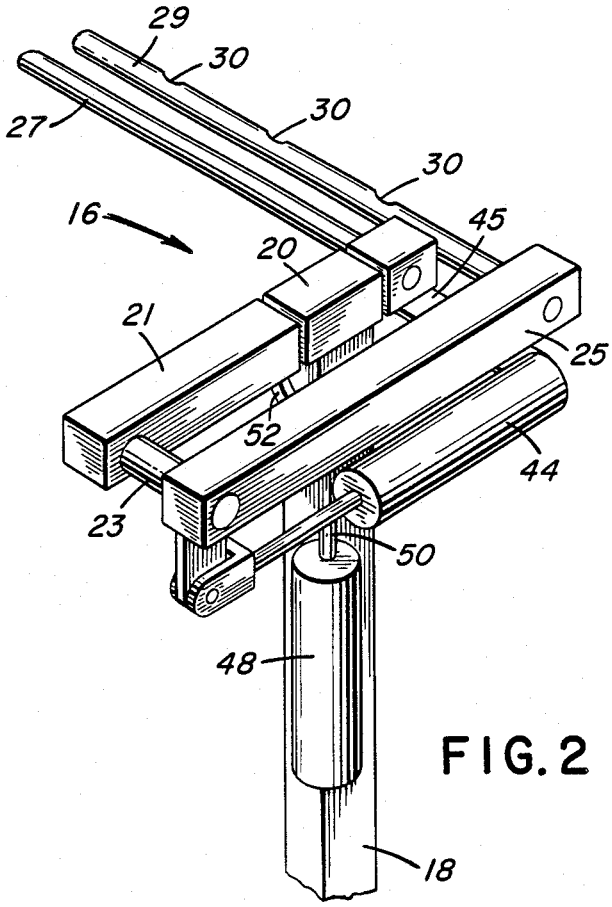
FIG. 2 is a perspective view of a detail of the stacker of FIG. 1.

The stacker 16 (FIG. 2) is formed by a vertical element 18 having at its upper end 20 a first rod 21 axially rotatably mounted thereto. Rod 21 is connected to element 18 in a manner preventing axial displacement but rotatable axially with reference to end 20.

At one end of first rod 21 one end of a pin 23 is fixed to which at the other end a second rod 25 is pivoted, free to rotate about the axis of rod 23. Two bars 27 and 29, parallel to each other, are fixed at the free ends of the rods 21 and 25 respectively. The bar 29 presents holes 30 from which air emits for facilitating the stacking of the sewn fabric piece, as will be explained hereinafter.

The vertical element 18 is pivoted at its lower end around a pin 32, by a first pneumatic cylinder 34.

Figure 3:
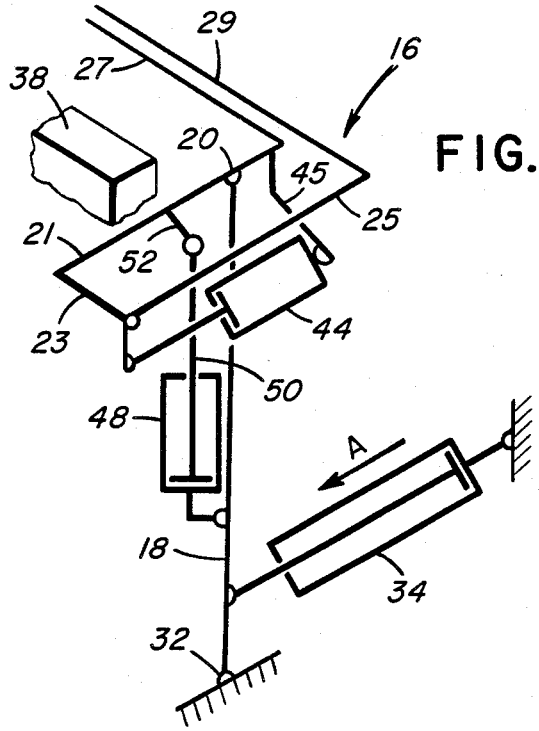
FIGS. 3, 4 and 5 show in a schematic way the operative sequence of the stacker of FIGS. 1 and 2.
Figure 4:
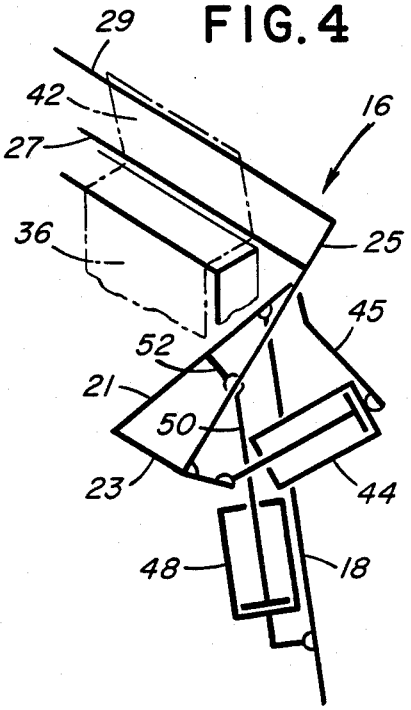

In FIG. 3, the stacker 16 is schematically illustrated in its inoperative position. When a sewn piece must be stacked, the pneumatic cylinder 34 is operated, which moves its piston in the direction of the arrow A. This displacement of the piston of cylinder 34 causes a rotation of the vertical element 18 around the pin 32 so as to direct bar 27, fixed to the rod 21, toward pieces 36 (indicated in FIG. 4 with dotted line), which already have been sewn and stacked on a support 38 fixed by means of a brace 40 at the frontal part of the automatic sewing unit 10 (FIG. 1) near the sewing station 14. The bar 27 presses in this way the sewn piece 42 to be stacked (FIG. 4) against the piece 36.

A second pneumatic cylinder 44, fixed by means of a lever 45 to the rod 21, is activated. The displacement of the piston of pneumatic cylinder 44 causes the rotation of the rod 25 around the pin 23 so that the bar 29 moves to carry the upper portion of the piece 42 to pieces 36 on the support 38.

Through the holes 30 of the bar 29, a jet of air is forced to exit, which frees the upper portion of the piece 42 from the bar 29 and facilitates the stacking of piece 42 onto the stacked pieces 36. After stacking, the second cylinder 44 is activated once more to bring back the rod 25, and consequently, the bar 29 to their inactive positions.

Figure 5:
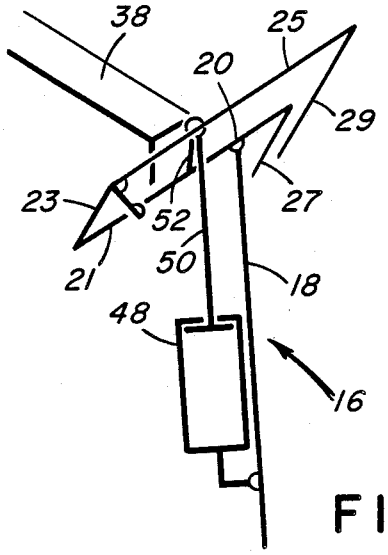

During the stacking phase of the piece 42, a new piece 46 is made ready at the loading station 12 (FIG. 1) and is transferred to the sewing station 14. In order to prevent bars 27 and 29 from interfering with the new piece 46 being sewn when the stacker 16 is returning to its inoperative position, of FIG. 3, a third pneumatic cylinder 48 is activated, which is fixed to vertical element 18. Piston rod 50 of cylinder 18 is pivoted at one end to bar 52 which is fixed to rod 21. The piston rod 50 of cylinder 48 (FIG. 5), when activated, causes the rod 21 to rotate axially with respect to the end 20 of the vertical element 18. Due to connections pin 23, lever 45, cylinder 44, and rod 25 rotate around rod 21, thus causing the rotation of the bars 27 and 29 downwardly, as is illustrated in FIG. 5 and FIG. 1 by dotted line. At the same time, the first pneumatic cylinder 34 displaces its piston in the opposite direction to move the stacker 16 toward its position illustrated in FIG. 3.

When the first pneumatic cylinder 34 has completed its return movement, then pneumatic cylinder 48 is activated to move rods 21 and 25, and consequently bars 27 and 29, to their positions illustrated in FIG. 3. In this way, the new piece 46, which previously had been transferred to the sewing station 14, is placed over the bars 27 and 29 and between the bars 27 and 29 and the support 38, ready to be stacked at the end of the sewing cycle. By this rotation of bars 27 and 29 during the return mmovement of the stacker to its inoperative position, an interference between bars 27 and 29 and the new piece to be sewn is avoided. The productivity of the automatic sewing unit 10 increases due to the inoperative time at the sewing station being reduced, because it is possible to transfer a fabric piece from the loading station 12 to the sewing station 14 while the previously sewn piece is automatically stacked.

We claim:

1. Fabric piece stacker applied to a sewing machine comprising a vertical element, a first rod axially rotatably attached to one end of said element, a second rod, a pin interconnecting said first and second rods at one end of each, a bar fixed to the other end of each of said first and second rods, said bars being parallel and adapted to engage a sewn fabric piece and to stack it on a support, and means being provided to enable said vertical element and said rods to oscillate.

2. The stacker according to claim 1, wherein said means comprise:

first, second and third pneumatic cylinders;

said first pneumatic cylinder being connected to said vertical element to oscillate said vertical element, first and second rods, pin and bars; said second pneumatic cylinder being connected to said first and second rods to oscillate said second rod and bar around said pin; and said third pneumatic cylinder being connected to said vertical element and first rod to oscillate the pin, second rod and bars around the axis of said first rod.

3. The stacking according to claim 2, wherein said first pneumatic cylinder oscillates said vertical element from an inoperative position to a position where said bar of said first rod is displaced to press the piece to be stacked against said support;

said second pneumatic cylinder oscillates said second rod from an inoperative position to a position where said bar fixed to said rod is positioned to unload said sewn piece onto said support;

said third pneumatic cylinder oscillating said first rod from an inoperative position to a position where said bars are depressed to prevent interference with the loading and sewing of an unsewn piece.

4. The stacker according to claim 1, wherein the bar fixed to said second rod is a hollow core and defines orifices communicating with said core and atmosphere to permit the emission of air jets to aid in the unloading of the sewn piece from said bar onto said stack.

* * * * *

UNITED STATES PATENT AND TRADEMARK OFFICE

CERTIFICATE OF CORRECTION

PATENT NO. : 4,608,938

DATED : September 2, 1986

INVENTOR(S) : Flavio BISSON and Ernst SCHRAMAYR

It is certified that error appears in the above-identified patent and that said Letters Patent is hereby corrected as shown below:

Title page, [75] Inventor, after "Flavio Bisson, Cava Manara, Italy" the second inventor should appear:
--Ernst Schramayr, Foresport, New York--.

Signed and Sealed this

Twenty-seventh Day of January, 1987

*Attest:*

DONALD J. QUIGG

*Attesting Officer* *Commissioner of Patents and Trademarks*